US006446478B1

(12) United States Patent
Muller

(10) Patent No.: US 6,446,478 B1
(45) Date of Patent: Sep. 10, 2002

(54) TWO-STAGE HEMMING MACHINE WITH MOVABLE DIES

(75) Inventor: Colin Oliver Muller, Port Elizabeth (ZA)

(73) Assignee: Progressive Tool & Industries Co., Southfield, MI (US)

( * ) Notice: Subject to any disclaimer, the term of this patent is extended or adjusted under 35 U.S.C. 154(b) by 0 days.

(21) Appl. No.: 09/627,655

(22) Filed: Jul. 28, 2000

Related U.S. Application Data

(60) Provisional application No. 60/146,187, filed on Jul. 29, 1999.

(51) Int. Cl.[7] ..... B21D 39/02

(52) U.S. Cl. ..... 72/306; 72/323; 72/404; 72/420; 72/448

(58) Field of Search ..... 72/323, 322, 306, 72/420, 448, 404, 470; 29/243.5, 243.58, 243.57, 509

(56) References Cited

U.S. PATENT DOCUMENTS

| | | | | | |
|---|---|---|---|---|---|
| 3,092,057 | A | * | 6/1963 | Warshilek | 29/243.58 |
| 3,495,435 | A | * | 2/1970 | Hanni | 72/448 |
| 3,675,463 | A | * | 7/1972 | Munschauer | 72/448 |
| 4,317,358 | A | * | 3/1982 | Yonezawa | 72/448 |
| 4,706,489 | A | | 11/1987 | Dacey, Jr. | 72/450 |
| 5,005,398 | A | | 4/1991 | Evans | 72/450 |
| 5,237,734 | A | | 8/1993 | Polon | 29/513 |
| 5,272,903 | A | | 12/1993 | Evans | 72/403 |
| 5,457,981 | A | | 10/1995 | Brown et al. | 72/451 |
| 5,647,243 | A | | 7/1997 | Zampini | 72/452.6 |
| 5,735,162 | A | | 4/1998 | Mattsson | 72/315 |
| 5,740,691 | A | | 4/1998 | Kovarovic et al. | 72/306 |
| 6,098,440 | A | * | 8/2000 | Gorgen | 72/323 |
| 6,125,683 | A | * | 10/2000 | Toeniskoetter | 72/426 |
| 6,182,492 | B1 | * | 2/2001 | Raffin | 72/448 |

FOREIGN PATENT DOCUMENTS

JP 2-70325 * 3/1990

* cited by examiner

*Primary Examiner*—Daniel C. Crane
(74) *Attorney, Agent, or Firm*—Young & Basile, P.C.

(57) ABSTRACT

A two-stage hemming machine has a centrally located press station with an anvil extendable along a vertical axis, and a loading station and an unloading station located on opposite sides of the press station. Separate first and second dies slide on horizontal tracks mounted above the press, the first die movable therealong between the loading station and the press station, and the second die movable between the unloading station and the press station. The dies shuttle back and forth, in unison, between the press station during a production cycle wherein a component to be hemmed is loaded into the first die in the loading station, is carried into the press station along with the first die where the first stage of the hemming operation occurs, and remains on the anvil as the anvil is lowered. The first die then returns to the loading station as the second die moves into the press station. The anvil is extended again to perform a second stage of the hemming operation, the anvil is retracted, the component remaining in contact with the second die, and the second die moves to the unloading station where the component is removed from the press. Spring actuated arms hold the component in connection with the first die as the first die moves to the press station, and a power actuated retaining arm holds the component in connection with the second die as the second die moves to the unloading station.

20 Claims, 5 Drawing Sheets

TWO-STAGE HEMMING MACHINE WITH MOVABLE DIES

RELATED APPLICATIONS

This application is a continuation of U.S. Provisional Application Serial No. 60/146,187 filed Jul. 29, 1999.

FIELD OF THE INVENTION

This invention relates to hemming machines used to join sheet metal panels into a component such as an automobile body assembly. In particular, the invention relates to a method and apparatus for performing a two-stage hemming operation using a single, moveable anvil and two movable dies.

BACKGROUND OF THE INVENTION

Hemming is a manufacturing technique that is widely used in the automotive industry for joining two sheet metal panels together to form an external body component such as a door, hood or tailgate assembly. Typically, the panel forming the external skin of the component is joined to an inner reinforcing panel around substantially the entire periphery of the component. In the hemming process, this is achieved by folding the outer, peripheral edges of the outer panel over and around the outer edges of the inner panel.

At the beginning of the hemming process, any edge of the outer panel that is to be hemmed is already bent to form a flange which extends generally perpendicular to the main portion of the panel. This flange is usually produced during the stamping operation that forms the outer panel. For purposes of description, it will be assumed that the outer panel is oriented so that the flanges extend upwardly. The inner panel is then placed on top of the outer panel so that it nests within the upturned flanges of the outer panel.

The folding over or hemming of the outer panel flanges is typically completed in at least two stages. In the first stage, a die or tool strikes the flange to bend it inwardly approximately 35° to 55° from its original vertical orientation. In the second stage, a different die or tool strikes the inward slanting flange to bend it through the remainder of the approximately 90° required to make the flange lay flat against and wrap tightly around the edge of the inner panel.

One conventionally known process for performing a two-stage hemming operation on large automotive body components uses two separate presses each including a stationary lower die, commonly known as an anvil, and a vertically movable upper die. The component is placed on top of a first anvil and a first upper die is urged downwardly by a hydraulic or electrically powered press to contact the component and perform the first stage. The component is then removed from the first anvil and placed on a second anvil, which includes a second upper die and is actuated in a similar manner to perform the second stage. This conventional dual press operation incurs the additional cost of purchasing and maintaining two separate presses. Two separate presses also occupy a substantial amount of floor space in a plant.

It is also known to execute a two-stage hemming process using a single hemming press in which movable, cam-operated tools are used to change the geometry of the dies between strokes. The panels are placed in the anvil, and the press is actuated with the tools in a first position to perform the first stage. The press is opened, the tools are moved to a second position, and the press is actuated a second time to perform the second stage. In such a process, a finished component is ejected from the machine every two times the press is actuated.

As described above, the anvil of a conventional hemming press is stationary and an upper die is urged downwardly by a press to hem the component. An adhesive is typically applied between the panels in the area of the hem to ensure a tight seal between the panels and to prevent corrosion-causing moisture from entering the component. As the component is hemmed, a small amount of excess adhesive squeezes out of the joint and sticks to the upper die which contacts the inner panel.

This excess adhesive must be periodically removed from the die, and this is normally accomplished by manually scraping the die while it is in a raised position. In the conventional hemming press described above, the scraped-off excess adhesive falls downwardly onto the anvil, so that the anvil must then be cleaned before production can resume.

SUMMARY OF THE INVENTION

It is desirable in the present invention to provide a method and apparatus for producing hemmed sheet metal components in a faster and more economical manner than is possible with conventional hemming presses. A hemming machine according to the present invention can include a power-actuated press station which moves an anvil along a press axis between a retracted position and an extended position, a die movable between a first stamping position aligned with the press axis and a loading position wherein the first die is offset from the press axis, and a second die movable between the stamping position and an unloading position wherein the second die is offset from the press axis.

The hemming machine provided by the present invention is operated by loading the component to be hemmed into the first die when it is in the loading position, moving the first die and the attached component to the stamping position and extending the press to urge the anvil into contact with an un-hemmed component to perform the first stage of the hemming operation. The component remains in contact with the anvil as it is lowered, and the first die is then returned to the loading position. The second die then moves from the unloading position to the stamping position, and the anvil is extended again to perform a second stage of the hemming operation. The anvil is then returned to the retracted position, the component remaining in contact with the second die, and the second die is moved to the unloading position where the component is removed from the press.

A hemming machine according to the invention is more compact than the prior designs using two separate presses. The machine and method provided herein offers a short cycle time, since the first stage of the hemming operation can be performed while a completed part is removed from the second hemming die, and the second stage of the hemming operation can be performed while a new part is loaded into the first die.

In a preferred embodiment of the invention, the press axis is oriented vertically and extension of the press moves the anvil upwardly toward the first and second dies, which have their component-contacting surfaces oriented downwardly. The first and second dies are linearly movable along horizontal axes. Accordingly, a component to be hemmed is loaded into a centrally-located press station from a first side of the press, both the first and second stage of the hemming operations take place in the press station, and the finished hemmed component is unloaded from the press station on a different side of the press, creating a very efficient work flow.

According to another feature of the invention, means are provided for holding the component in connection with the first die as it moves from the loading position to the stamping position in the press station, and for releasing the component after the first hemming stage is complete, so that the component remains in contact with the anvil as it is retracted downwardly. In this fashion, the component is automatically transferred from the loading position into the press station by the movement of the first die, and remains in the press station as the first die returns to the loading position and the second die moves into the press station in preparation for the second stage hemming stroke.

The hemming machine of the present invention also preferably includes means disposed on the second die for engaging the component when the component is raised into contact with the second die during the second stroke of the press station, and holding the component in connection with the second die as it moves to the unloading position after completion of the second hemming stroke. In this fashion, the finished component is automatically transferred out of the press station to the unloading station by the movement of the second die.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
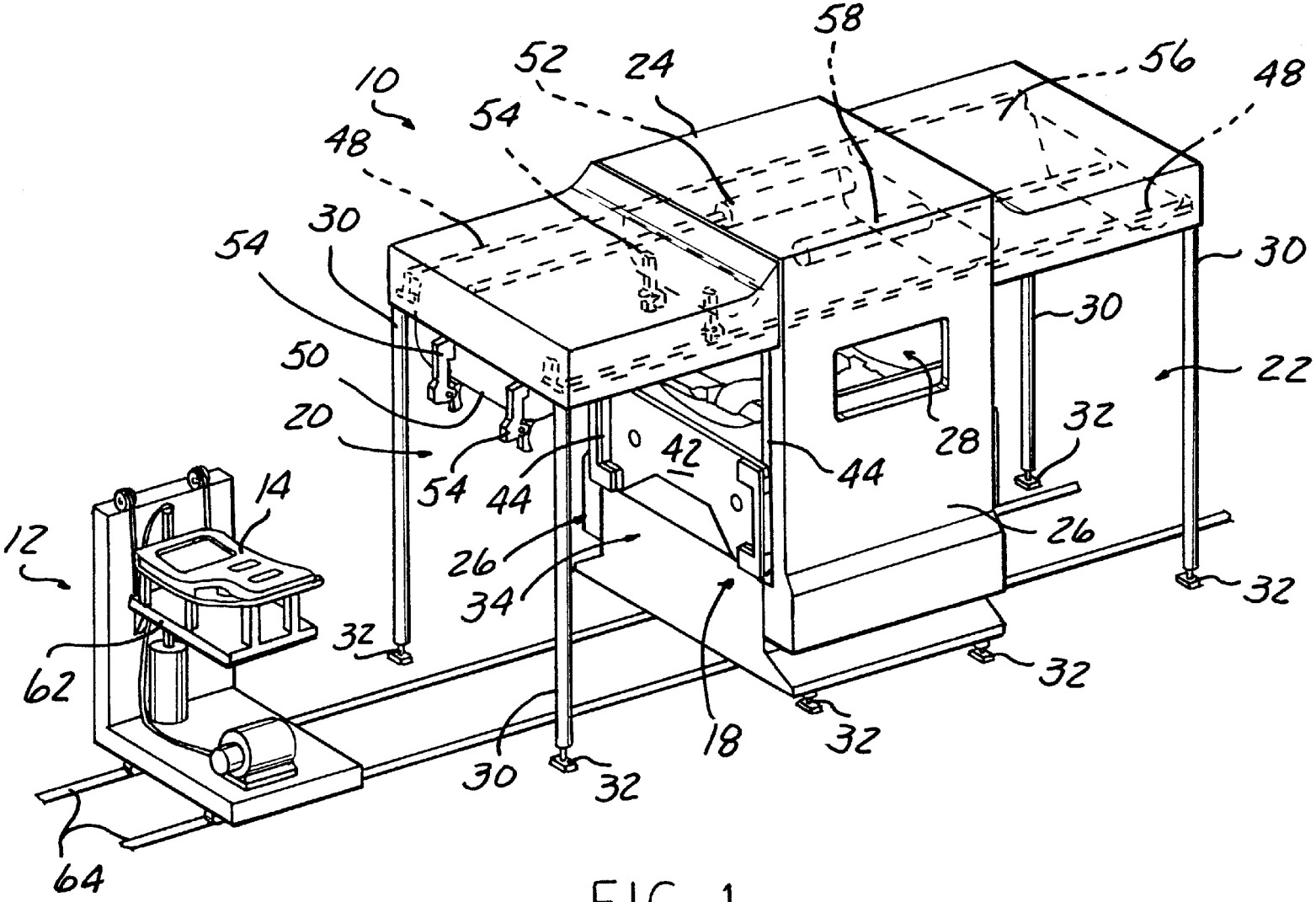
FIG. 1 is a perspective view of a hemming machine according to the present invention.

Referring to FIGS. 1–6, a hemming machine 10 according to the present invention is depicted along with a loading carriage 12 for loading a component 14 to be hemmed into the machine 10 and an unloading carriage 16 for removing the component from the machine after hemming. The component 14 depicted herein is a door for an automotive vehicle, but it is to be understood that the present invention can be employed to hem any type of sheet metal component or assembly. The component 14 includes an upper panel or reinforcing panel 14*a*, a lower panel or outer skin 14*b* and a flange 14*c* that are nested together (see FIG. 3) prior to being joined into a unitary assembly in the hemming operation.

The hemming machine 10 includes a centrally located press station 18, a loading station 20 disposed on a first side of the press station 18, and an unloading station 22 disposed on an opposite, second side of the press station 18. A top frame 24 extends across substantially the full length of the hemming machine 10 above the loading station 20, the press station 18 and the unloading station 22. The top frame 24 is preferably constructed of steel castings bolted and keyed together to form a truss. First and second side frames 26 are also constructed of steel castings, and extend from the top frame 24 downwardly to the floor on either side of the press station 18. One or both of the side frames 26 preferably have a viewing window 28 formed therein which are covered with high-strength, transparent polycarbonate sheet. Support pillars 30 are located at each of the four corners of the top frame 24 and extend downwardly to the floor. Adjustable leveling feet 32 are located at the bottoms of the support pillars 30 and at points along the lower edges of the side frames 26 so that the machine 10 can be made level and true when installed on a shop floor.

Referring now to FIGS. 2A–2F, a press 34 is disposed in the press station 18 and includes a piston 38 extending from a base 40. An anvil 42 is attached to the upper end of the piston 38 for vertical movement therewith, sliding up and down along vertical tracks 44 mounted to or integral with, the side frames 26 (shown in FIG. 1). The inner surface 46 of the anvil 42 (shown in FIG. 4) is shaped to match the particular component that the hemming machine 10 is designed to hem. Generally, the inner surface 46 is concave so that the component 14 can rest thereon. The press 34, as depicted, is hydraulically powered. However, press 34 can be powered by a flywheel with clutch and brake, or by any other power source known in the art.

Figure 2A:
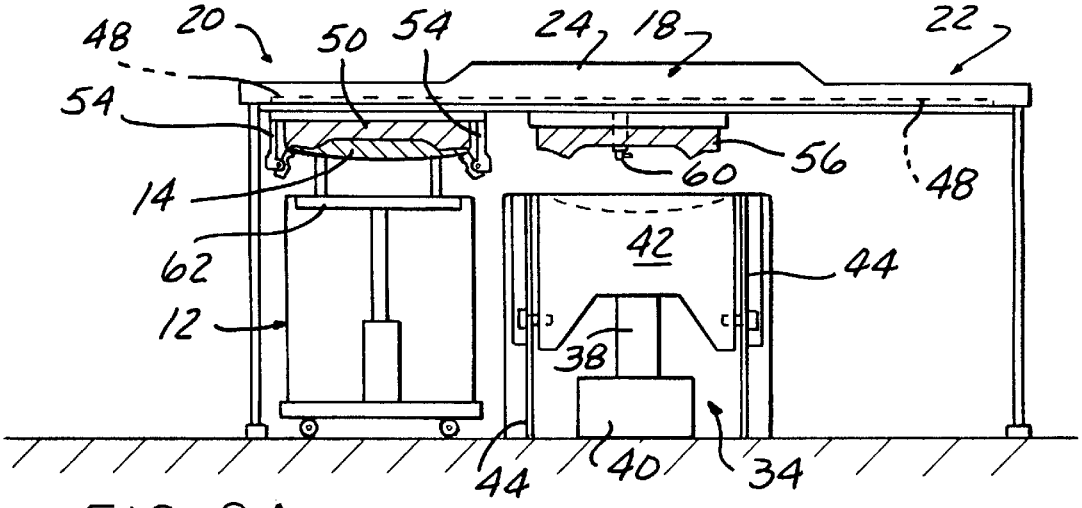
FIGS. 2A through 2F are a series of partially cut-away elevation views depicting the operating sequence of the invention hemming machine.
Figure 2B:
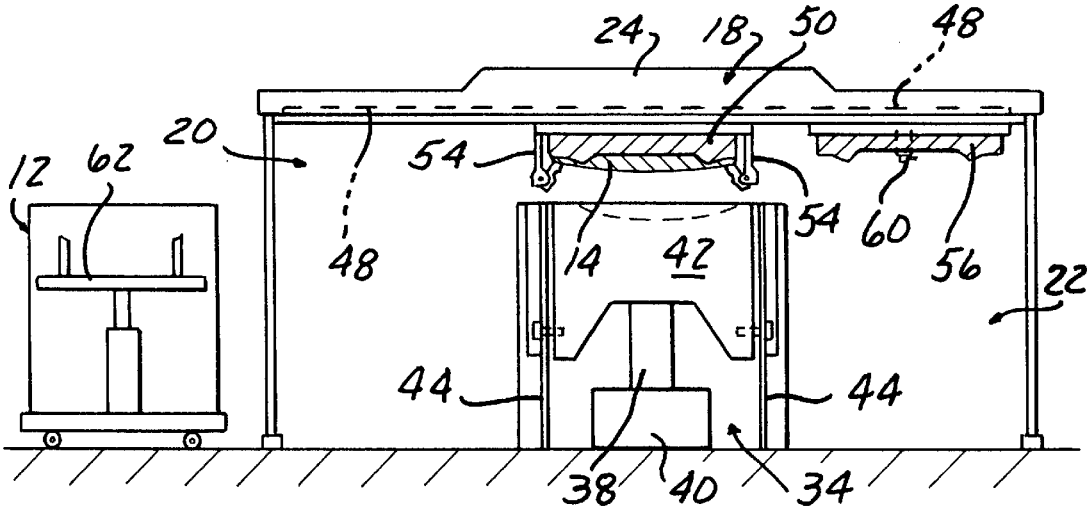

Overhead tracks 48 are attached to, or integral with, the lower side of the top frame 24 and extend horizontally from the loading station 20 through the press station 18 and to the unloading station 22. A first die 50 is mounted to slide along one end of the overhead tracks 48 (as viewed in FIGS. 2A–2F), between the loading station 20 and the press station 18. A hydraulic actuator 52 (as shown in FIG. 1) or other power drive means is disposed on the top frame 24 and is connected with the first die 50 to provide the motive force for sliding the first die 50 back and forth along the overhead tracks 48. A plurality of retaining arms 54 extend downwardly from the first die 50 at locations around its perimeter. A second die 56 is slidingly mounted to the overhead tracks 48 for movement there along between the unloading station 22 and the press station 18, and is powered by a second hydraulic actuator 58 mounted on the top frame 24. At least one retaining arm 60 extends downwardly from the second die 56 (as shown in FIGS. 2A–2B) The loading carriage 12 has a bed 62 for receiving the component 14 to be hemmed and can include means for vertical movement such as a chain drive actuated by an electric motor, or a hydraulic or pneumatic ram. The loading carriage 12 is movable between a first position immediately adjacent the loading station 20 (as shown in FIG. 1) and a second position within the loading station 20 directly beneath the first die 50. The loading carriage 12 can roll along guide tracks 64 disposed on the floor to allow for precise positioning within the loading station 20. The unloading carriage 16 (see FIG. 2F) is generally similar to the loading carriage 12 in construction and operation and is movable between a first position within the unloading station 22 and a second position outside of and adjacent to the unloading station.

The sequence of operation of the hemming machine 10 is as follows. Starting with the loading carriage 12 adjacent the loading station 20, the un-hemmed component 14 is positioned on the bed 62 of the loading carriage 12, as illustrated in FIG. 1. The loading carriage 12 is movable into the loading station 20. At this stage of the operating sequence, as seen in FIG. 2A, the first die 50 is in the loading station 20, the second die 56 is in the press station 18, and the press 34 is retracted so that the anvil 42 is in a lowered position.

The loading carriage bed 62 is raised to bring the component 14 into contact with the first die 50. As seen in FIG.

Figure 3:
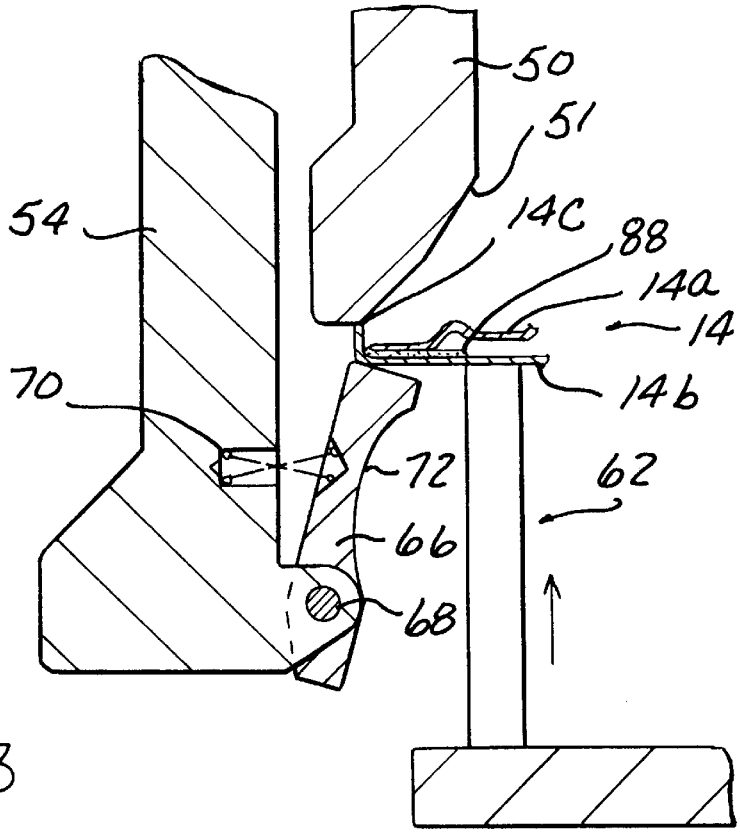
FIG. 3 is a detail view of a component being loaded into a first die.
Figure 4:
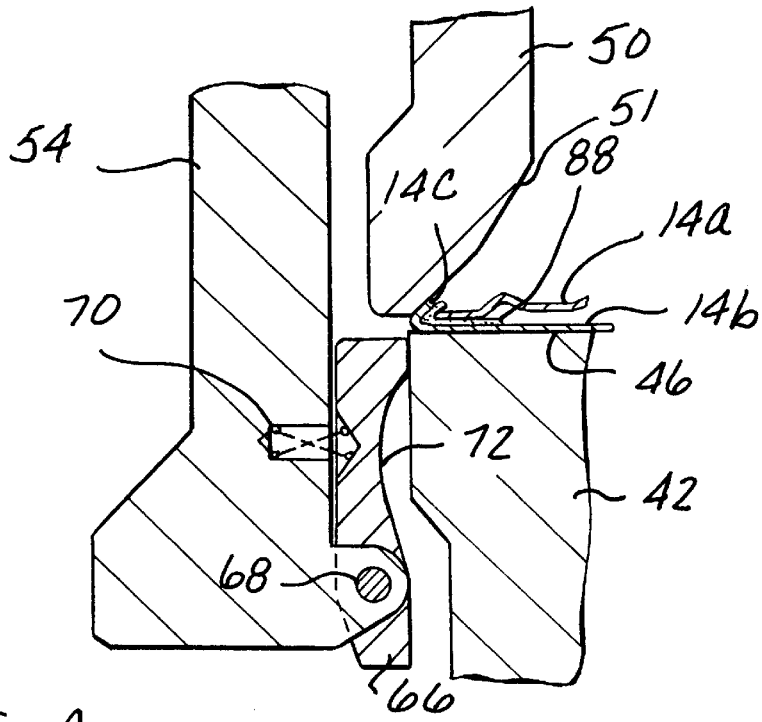
FIG. 4 is a detail view of the component during the first stage of the hemming operation.
Figure 5:
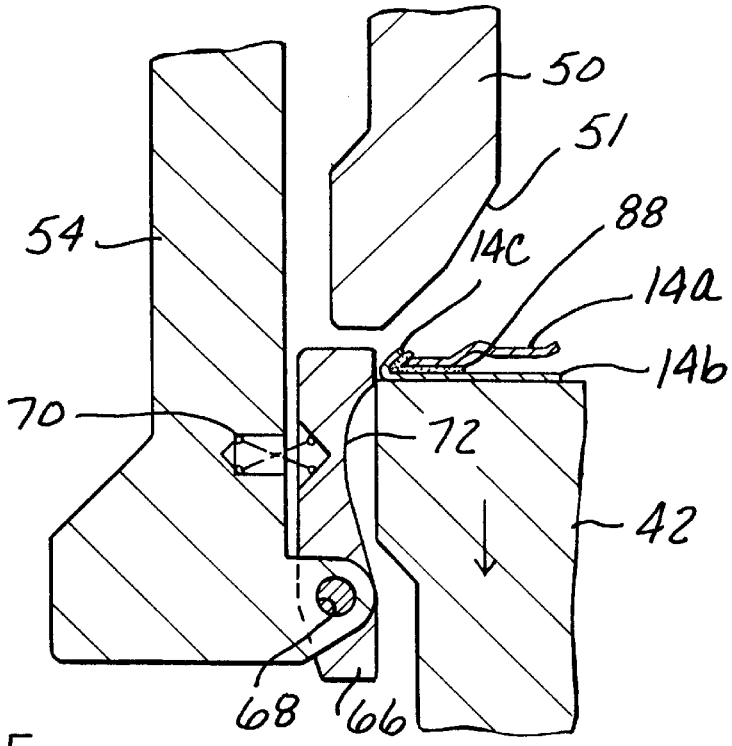
FIG. 5 is a detail view of the component resting on top of the press die after the first hemming stage.

3, the first die 50 has a lower or contacting surface 51 shaped to receive the component 14, and the component 14 fits between the retaining arms 54. Each retaining arm 54 has a finger 66 which pivots about a hinge pin 68 located near the lower end of the arm. The finger 66 is biased inwardly, toward the center of the first die 50, by a spring 70. As used herein, "inwardly" refers to direction generally towards said the center of first die 50. A cam surface 72 is formed on the inward-facing side of the finger 66. As the loading carriage bed 62 lifts the component 14 upwardly toward the first die 50, the outer edge of the component 14 contacts the cam surface 72 of the finger 66 to urge the finger 66 outwardly, against the force of the spring 70, so that the component 14 can pass between the retaining arms 54 and into contact with the first die 50. When the component 14 reaches the fully loaded position, as shown in FIG. 3, the fingers 66 snap inwardly to support the component 14 from beneath and hold the component in contact with the first die 50 when the bed 62 is lowered.

With the component 14 properly retained in connection with the first die 50, the hydraulic actuators 52,58 are actuated to slide the first die 50 into the press station 18 and the second die 56 into the unloading station 22, as seen in FIG. 2B. This movement positions the first die 50 in direct alignment with the vertical axis of the press 34. At this time, the loading carriage 12 can be moved out of the loading station 20.

Figure 2C:
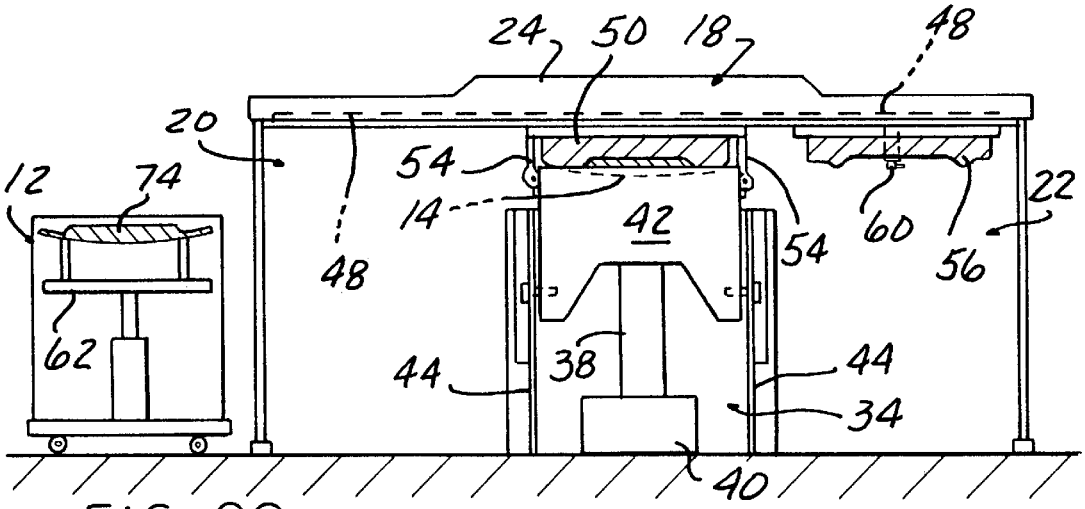
Figure 2D:
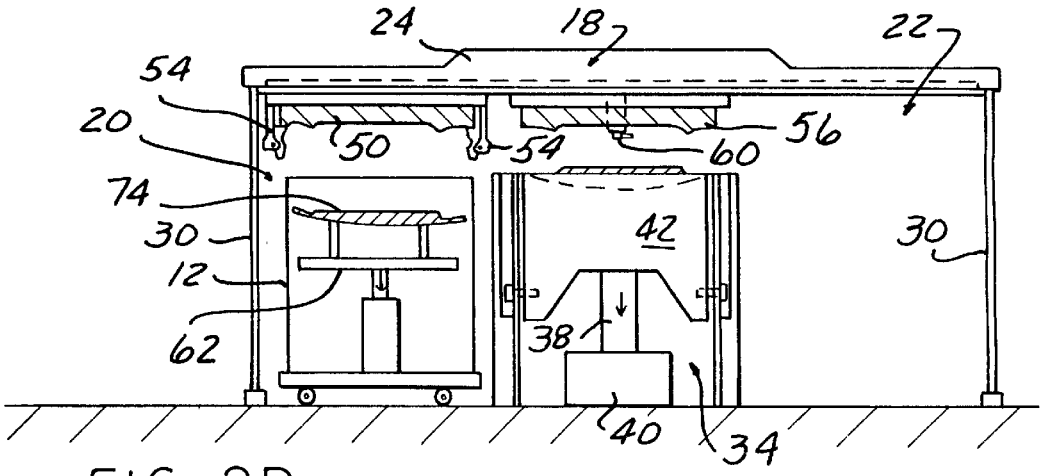
Figure 2E:
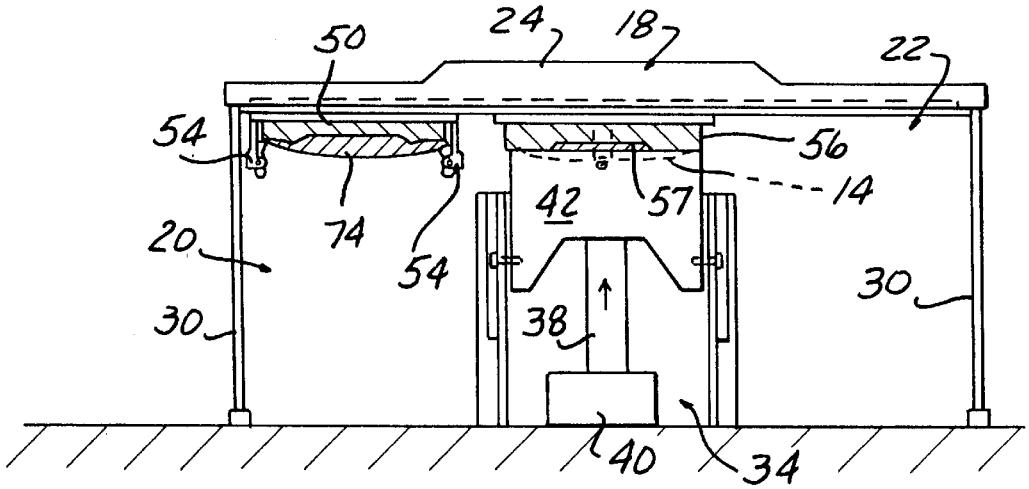

As seen in FIG. 2C, the press 34 is then actuated to urge the press die 42 upwardly into contact with the first die 50 and the attached component 14. The contacting surface 51 of the first die 50 and the inner surface 46 of anvil 42 coact to perform a first stage of the hemming operation. In the first stage of the hemming operation, a flange 14*c* extending upwardly around the edges of the outer skin 14*b* is bent inwardly approximately 45° so that the peripheral flange 14*c* wraps partially around the outer perimeter of the reinforcing panel 14*a*.

As the anvil 42 moves upwardly towards the component 14 and first die 50, the anvil 42 passes between the retaining arms 54 and contacts the cam surfaces 72 of the fingers 66 (see FIG. 4), urging the fingers 66 outwardly so that the retaining arms 54 release their engagement with the component 14. As the anvil 42 moves downward after the first stage of the hemming operation, anvil 42 continues to hold fingers 66 outwardly (see FIG. 5) so that the component 14 drops away from the first die 50 and remains on inner surface 46 (see FIG. 4) of anvil 42 to move downwardly therewith.

After the first stroke of press 34 has accomplished the first stage of the hemming operation, first die 50 slides back to the loading station 20 (see FIG. 2D) and second die 56 slides into the press station 18 and into alignment with the press axis 34. Also at this time, the loading carriage 12 with a second, un-hemmed component 74, positioned on bed 62, moves into the loading station 20 beneath the first die 50 to prepare for loading of the second component 74 into the first die 50.

Figure 6:
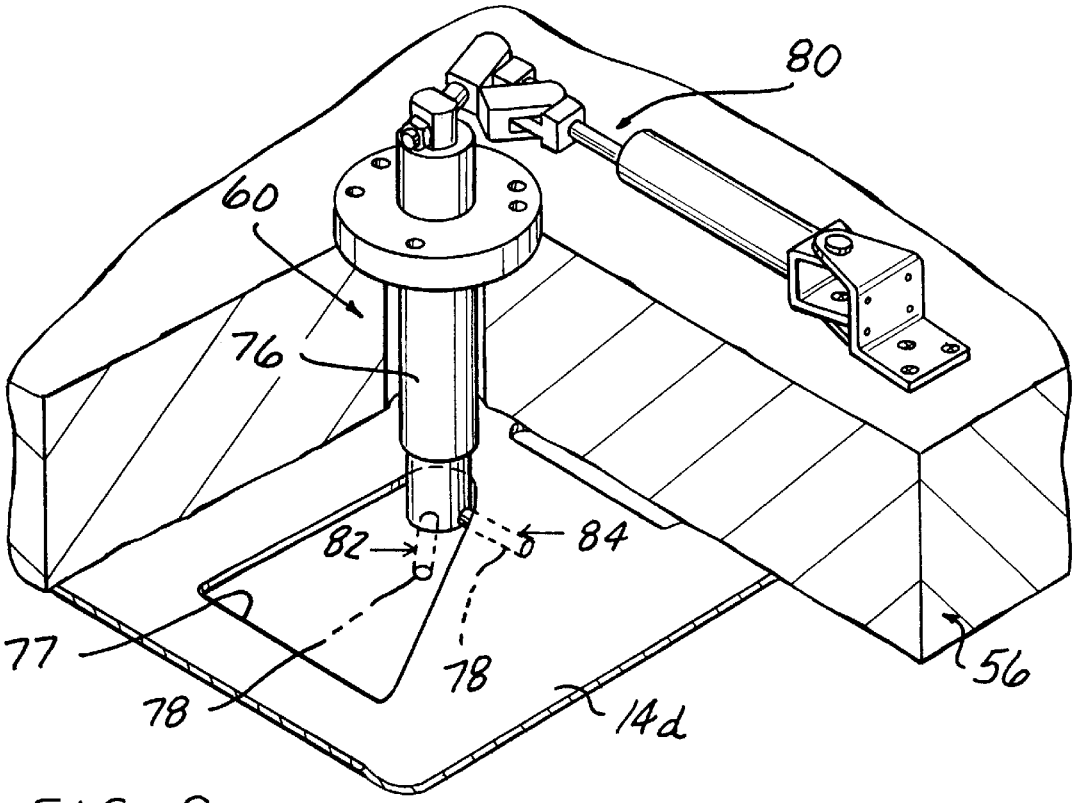
FIG. 6 is a detail view of the component being retained in connection with the second die.

As seen in FIGS. 2A–2F, the press 34 is then actuated a second time to urge the anvil 42 and the component 14 lying thereon upwardly into contact with the second die 56, having contact surface 57, to perform the second stage of the hemming operation and produce a completed component 14*d*. In the second stage of the hemming operation, the flange 14*c* of the outer skin 14*b* of the component is crimped tightly around the outer perimeter of the reinforcing panel 14*a* of the component 14. Prior to, or simultaneously with, the anvil 42 moving away from second die 56, retaining arm 60, extending from second die 56, is actuated to hold the component 14*d*. The hemmed component 14*d* is removed from anvil 42 as the anvil 42 retreats to the retracted position. In a preferred embodiment of the invention, as shown in FIG. 6, the retaining arm 60 includes a shaft 76 which extends downwardly through an aperture 77 in hemmed component 14*d* and has a finger 78 extending radially outward therefrom. Shaft 76 is rotatable by a power-actuated linkage 80 between a first angular position 82 shown in phantom line and a second angular position 84 shown in hidden line beneath reinforcing panel 14*a*. Shaft 76 is in first angular position 82 when anvil 42 moves upward to perform the second stage of the hemming operation, and the linkage 80 is actuated to move shaft 76 to second angular position 84 prior to the anvil 42 lowering so that the component 14*d* is held in contact with the second die 56.

Figure 2F:
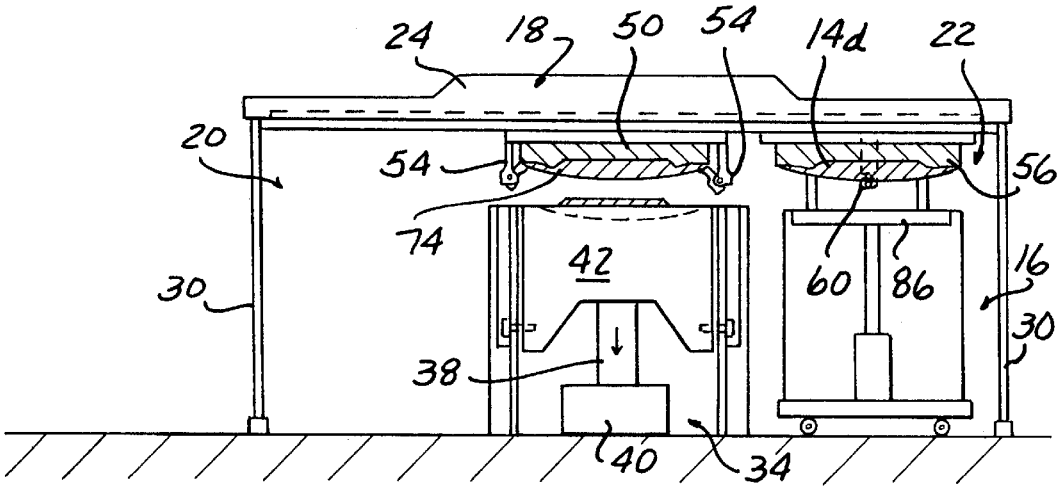

As seen in FIG. 2F, after anvil 42 lowers from second die 56, the hydraulic actuator 58 is actuated to slide the second die 56 and the attached hemmed component 14*d* into unloading station 22, and a vertically movable bed 86 of the unloading carriage 16 is raised into contact with the hemmed component 14*d* as seen in FIG. 2F. The retaining arm 60 is actuated to release the hemmed component 14*d* so that the finished, hemmed component 14*d* rests on the bed 86 of the unloading carriage 16 and can be lowered away from the second die 56 and removed from the unloading station 22. As the second die 56 and the hemmed component 14*d* move to the unloading station 22, the first die 50, now bearing the second, un-hemmed component 74, is simultaneously moved into press station 18 so that the press 34 can be extended to perform the first stage of the hemming operation on the second component 74 in a continuous production cycle. As is apparent from the foregoing description, the hemming machine 10 is particularly well suited for a continuous production cycle.

An un-hemmed component 14 is loaded into press station 18 each time the first die 50 moves into press station 18, and a completed, fully hemmed component 14*d* is removed from press station 18 each time the second die 56 moves to unloading station 22. When operated in this continuous production mode, the dies 50,56 preferably move simultaneously and in coordination with one another. That is, the first die 50, carrying an un-hemmed component 14, moves into press station 18 simultaneously with second die 56, carrying a fully hemmed component 14*d*, moving out of press station 18 to the unloading station 22. In the same fashion, the empty first die 50 moves back to the loading station 20, to receive a new, second component 74, simultaneously with the empty second die 56 moving back into press station 18, to perform the second stage of the hemming operation. The component 14 need not be manually handled between the time it is loaded in an un-hemmed condition into the loading station 20, and removal of the completed, fully hemmed component 14*d* from the unloading station 22.

A break in the continuous production cycle occurs when it becomes necessary to clean the dies. An adhesive (see FIGS. 3–4) is typically applied around the edges of the upper and/or lower panels 14*a*, 14*b* of the component 14 prior to loading. This adhesive 88 dries to form a corrosion resistant, moisture-tight seal at the locations where the outer skin 14*b* and reinforcing panel 14*a* are hemmed together. During the hemming operation, a certain amount of adhesive 88 is forced out of the overlaps between the panels and sticks to the first and second dies 50, 56. This dried, excess adhesive must be cleaned off of the dies 50, 56 at certain intervals to maintain proper functioning of the machine. The hemming machine 10 of the present invention has an advantage over prior art machines when cleaning must be performed. Cleaning is accomplished by positioning the first die 50 in the loading station 20 and the second die 56 in the unloading station 22, with neither of the dies 50, 56 carrying a component 14, 14*d*. The dried adhesive can then be scraped or otherwise cleaned off of the dies 50, 56 and, since the dies 50, 56 are not above the anvil 42, the adhesive falls to the floor in the loading and unloading stations 20,22 rather than onto surface 46 of the anvil 42. The cleaning of the present invention does not cause debris to fall into anvil 42, so the production process can then immediately resume without the need to clean adhesive scrapings off from the anvil 42. It should be noted that during the normal production sequence of the hemming machine 10, the first and second dies 50,56 are effectively joined so that the dies 50, 56 remain adjacent one another as the dies 50, 56 move between stations. It is only during cleaning that the first and second dies 50,56 are separated so that neither one is located in the press station 18. This is in contrast to conventional hemming presses where upper dies are always positioned directly over the anvil and any adhesive scraped off from the die falls into the anvil. This requires the scraped off adhesive to be removed before the hemming operation can resume.

It has been found that a hemming machine 10 according to this invention is well adapted for operation with a much shorter press stroke than a conventional hemming press. Specifically, while a conventional hemming press has a stroke averaging thirty to forty inches, a hemming machine according to the present invention has been found to operate effectively using a stroke of only approximately eight inches. This shorter stroke length is a result of the manner in which the components 14, 14*d* are shuttled into and out of the press station in connection with the first and second dies 50, 56, and results in a significantly reduced cycle time during production, and hence greater efficiency In one possible alternative to the preferred embodiment depicted herein, one or both of the loading and unloading carriages 12,16 can be oriented to roll into and out of the loading and unloading stations 20, 22 in directions perpendicular to the axis along which the dies travel. In another possible alternative configuration, the axes of sliding movement of the first and second dies 50, 56 can be oriented at 90° to one another, rather than being parallel as shown in the preferred embodiment. Either of these alternatives can be advantageous due to space constraints in a particular equipment layout within a plant. This can be the case, for example if it is desired to place the machine near a corner or a wall.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for performing a hemming operation on a sheet metal component comprising:

an anvil moveable along an axis while supporting a sheet metal component;

a first die moveable between a loading position spaced from the axis and a stamping position aligned with the axis, such that movement of the anvil toward the first die performs a first stage of a hemming operation, the first die delivering sheet metal components to the anvil during the first stage of the hemming operation; and a second die moveable between the stamping position aligned with the axis and an unloading position offset from the axis, such that movement of the anvil toward the second die performs a second stage of the hemming operation, the second die removing sheet metal components from the anvil during the second stage of the hemming operation.

2. The apparatus of claim 1 wherein the first die is linearly movable between the loading position and the stamping position along a loading axis generally perpendicular to the axis of movement of the anvil, and the second die is linearly movable between the unloading position and the stamping position along an unloading axis generally perpendicular to the axis of movement of the anvil, the first and second dies moveable with respect to each other.

3. The apparatus of claim 2 wherein the loading axis and the unloading axis are parallel with one another.

4. The apparatus of claim 1 wherein the axis of movement for the anvil is substantially vertical.

5. An apparatus for performing a hemming operation on a sheet metal component comprising:

an anvil having first surface, the anvil moveable along a substantially vertical axis;

a press secured to the anvil opposite from the first surface for moving the anvil along the axis;

a first die having a first contacting surface, the first die moveable between a loading position spaced from the axis and a stamping position aligned with the axis, such that extension of the press urges the anvil toward the first die to perform the first stage of a hemming operation; and a second die having a second contacting surface, the second die moveable between the stamping position aligned with the axis, such that extension of the press urges the anvil toward the second die to perform the second stage of a hemming operation and an unloading position offset from the press wherein the first and second contacting surfaces of the first and second dies are oriented downward, and extension of the press moves the anvil upwardly toward one of the first and second dies positioned at the stamping position.

6. The apparatus of claim 5 further comprising:

means, disposed on the first die, for holding a hemmable component adjacent to the first contacting surface while the first die moves from the loading position to the stamping position, and for releasing the hemmable component subsequent to the first stage of a hemming operation.

7. The apparatus of claim 6, wherein the holding and releasing means further comprises:

at least one inwardly biased member pivotally moveable from a carrying position, wherein the member is engageable with the hemmable component, to an outward releasing position when the first stage of a hemming operation is performed.

8. The apparatus of claim 5 further comprising:

means, disposed on the second die, for holding a hemmed component adjacent to the second contacting surface as the second die is moved from the stamping position to the unloading position, and for releasing the hemmed component at the unloading position.

9. The apparatus of claim 8, wherein the hemmed component includes an aperture and the holding means further comprises:

a rotatable shaft and a finger, wherein the shaft is rotatable between a first angular position and a second angular position, the finger projecting generally perpendicularly from the shaft, the shaft capable of passing through the aperture during the second stage of a hemming operation, and rotatable to operably engage the finger with the hemmed component.

10. The apparatus of claim 5 further comprising:

a loading carriage with a bed; and lifting means for elevating the sheet metal component into proximity with the first die at the loading station.

11. A method of performing a hemming operation on a sheet metal component with a press having an anvil linearly moveable along an axis between a retracted position and an extended position, comprising the steps of:

loading a hemmable sheet metal component into a first die disposed at a loading position, wherein the first die is offset from the axis;

moving the first die and the component to a stamping position, wherein the first die is in alignment with the axis;

moving the press to the extended position to urge the anvil toward the first die and to form a first stage of a hemming operation on the component;

returning the press to the retracted position, the component remaining in contact with the anvil;

returning the first die to the loading position;

moving a second die from an unloading position, wherein the second die is offset from the axis, to the stamping position;

moving the press to the extended position to urge the anvil towards the second die and perform a second stage of a hemming operation on the component;

returning the press to the retracted position, the component remaining in contact with the second die; and moving the second die to the unloading position and removing the component from the second die.

12. The method of claim 11 further comprising the steps of:

loading a second hemmable sheet metal component into the first die after the first die returns to the loading position;

moving the first die and the second component to the stamping position after the second die moves to the unloading position; and moving the press to the extended position to execute the first stage of the hemming operation on the second component while the component is being removed from the second die.

13. The method of claim 11 wherein the step of moving the first die to the stamping position further comprises the step of moving the first die substantially linearly along a loading axis generally perpendicular to the axis of movement of the anvil, and wherein the step of moving the second die to the unloading position further comprises the step of moving the second die substantially linearly along an unloading axis generally perpendicular to the axis of movement of the anvil.

14. The method of claim 11 wherein the axis of movement of the anvil is oriented substantially vertically, and the first and second dies are oriented downward, such that the step of moving the press to the extended position further comprises the step of moving the press upward and wherein the step of moving the press to the retracted position further comprises the step of moving the press downward.

15. The method of claim 14 wherein the loading step further comprises the step of using a lift to elevate the component into proximity with the first die for loading the component with respect to the first die.

16. The method of claim 14 wherein the loading step further comprises the step of retaining the component in proximity to the first die with at least one member biased to a first position, wherein the member engages the component, and wherein the step of moving the press to the extended position further comprises the step of moving the member to a second position, wherein the member releases the component.

17. An apparatus for performing a hemming operation on a sheet metal component comprising:

an anvil having a first surface;

a press having an axis, the press moving the anvil between first and second positions along the axis;

a pre-hemming die for receiving an un-hemmed component in contact with a first contacting surface, the pre-hemming die moveable between a loading position offset from the axis and a stamping position located along the axis;

a loading carriage for delivering the un-hemmed component into engagement with the pre-hemming die;

a hemming die for receiving a partially hemmed component in contact with a second contacting surface, the hemming die moveable between an unloading position offset from the axis and the stamping position; and an unloading carriage for removing a hemmed component.

18. The apparatus of claim 17 further comprising:

means for securing the un-hemmed component to the pre-hemming die including a plurality of fingers, attached to the pre-hemming die, and engageable with the unhemmed component, wherein the un-hemmed component is secured to pre-hemming die prior to completion of a pre-hemming operation.

19. The apparatus of claim 17 further comprising:

means for holding a hemmed component to the hemming die including a rotatable retaining arm having a shaft and a finger.

20. The apparatus of claim 17, wherein the pre-hemming die and the hemming die move in synchronous movement.

* * * * *